United States Patent [19]

Egri

[11] Patent Number: 4,564,031

[45] Date of Patent: Jan. 14, 1986

[54] SMOKABLE, COHERENT SHEET AND METHOD FOR ITS MANUFACTURE

[75] Inventor: Laszlo Egri, Basel, Switzerland

[73] Assignee: Tamag Basel AG, Basel, Switzerland

[21] Appl. No.: 509,205

[22] Filed: Jun. 29, 1983

[30] Foreign Application Priority Data

Jun. 30, 1982 [DE] Fed. Rep. of Germany ..... 3224416

[51] Int. Cl.[4] ..... A24B 3/14

[52] U.S. Cl. ..... 131/353; 131/358; 131/370

[58] Field of Search ..... 131/358, 352, 353, 355, 131/370, 360, 359

[56] References Cited

U.S. PATENT DOCUMENTS 3,121,433 2/1964 Plunkett et al. ..... 131/370

3,386,449 6/1968 Hind ..... 131/370

*Primary Examiner*—V. Millin

*Attorney, Agent, or Firm*—Bert J. Lewen; Henry Sternberg

[57] ABSTRACT

A smokable, coherent sheet of disintegrated vegetable materials and/or tobacco waste, said sheet being provided with a water-insoluble film on one surface and being obtained in that the vegetable materials and/or tobacco waste are pressure-formed with binding agents and water, the share of which is lower than that of the dry substance employed, between forming elements, the formed, coherent and still moist sheet is coated at a moisture content of 30 to 50% with a solution or suspension having at least one water-soluble, modified pectin from the group of low-esterified pectin with an esterification degree of below 40% and/or amidified, low-esterified pectin with an amidation degree of over 15%, the modified pectin is contacted with bivalent and/or trivalent metal ions and the coated sheet is dried, with the concentration of the modified pectin on the sheet surface being at least 0.5 percent by weight, as referred to the dry weight of the finished product. This smokable sheet shows a good smoke quality, an increased filling power of the tobacco produced therefrom and a high moisture resistance.

10 Claims, No Drawings

SMOKABLE, COHERENT SHEET AND METHOD FOR ITS MANUFACTURE

This invention relates to a smokable, coherent sheet of disintegrated vegetable materials and/or tobacco waste, said sheet being provided with a water-insoluble film on one surface.

The production of regenerated smokable products of disintegrated vegetable material, preferably of tobacco, is at present carried out mainly by using the following three methods and systems:

(1) Paper Method

The shredded tobacco is washed with a relatively large amount of water, with a part of the washing liquid being recirculated. The felted tobacco fibers including a relatively high proportion of cellulose fibers are poured into a sieve belt. Drying of the thus formed web to the desired final moisture content requires a substantial amount of energy due to the high initial moisture content.

(2) Slurry Method

The ground tobacco is mixed with about ten parts of water and a suitable proportion of binding agents, and the resulting slurry is poured into a steel belt. Also in this method, the high moisture content requires an excessive amount of energy for drying.

(3) Extruder Method and/or Roller System

The disintegrated tobacco is mixed with binding agents, water and/or solvents, generally at a smaller proportion than that of the dry substance, and the resulting pasty mass is pressure-formed into sheets by extruding and/or forming by means of rollers and/or belts, the sheets then being dried to the desired final moisture content with relatively low energy requirements.

In the paper method and in the slurry method, practically no pressure is applied in the forming, and the sheet produced in such a way has therefore in the cut condition a considerable filling power. This means a saving of tobacco raw material, as the decisive factor in the manufacture of cigarettes is not the weight but the hardness of the cigarettes at a given volume.

The sheet material produced by the extruder method and/or roller method, i.e. with a small amount of water and under application of pressure, is generally of a lower filling power, thus partially offsetting the advantages gained by energy-saving at the manufacture step. It is assumed that this is to be ascribed to the compact structure and to the less porous structure respectively, as compared to the sheet material produced by the paper method or slurry method. Tobacco sheet material, on the other hand, intended for employ as covers or wrappers in the manufacture of cigars do not require a high filling power, in place of which it has to be highly water resistant or resistant to saliva respectively, as it gets into direct contact with the lips when the cigar is being smoked.

U.S. Pat. No. 2,797,689 already describes a method for improving the water-resistance of smokable sheets, by employing carboxymethyl cellulose (free acid) as a binding agent. The carboxymethyl cellulose, however, imparts the smoke with an excessive pungency, which is endeavoured to be reduced by the addition of suitable silicon catalysts.

There are still further methods for improving the water-resistance, for instance the employing of so-called crosslinking agents as glyoxal and the like, as has been described in German Pat. No. 2,653,377.

Also known are methods for improving the resistance to saliva of sheet material produced according to the slurry method so that it can be used particularly for cigar wrappers.

A process of this kind results from U.S. Pat. No. 3,185,161, according to which a cellulose polymer, for instance alcohol-soluble ethyl cellulose, which is soluble in an organic solvent and which is insoluble after the removal thereof, is applied as a coating material on the surface of a smokable sheet material.

In the process known from U.S. Pat. No. 3,016,907, tobacco dust is dusted onto a film consisting of a binder and tobacco. For protecting the tobacco dust carried on the surface against mechanical abrasion, it is sprayed with various binding agent solutions and subsequently dried. The binding agent employed for preventing abrasion of the dust may consist of methyl cellulose, dextrin, pectin, alginate, starch and the like.

All of these methods are, however, not directed to the improvement of filling power.

In most of the named methods, the moist sheet material is dried before the coating material is applied, preferably sprayed thereon, whereafter it is again dried to the desired final moisture content. For instance according to U.S. Pat. Nos. 3,185,161 and 3,185,162 a tobacco sheet material having a thin hydrophobic coating on at least one surface is produced by forming a tobacco sheet of finely divided tobacco and a water-soluble binding agent in aqueous solution, drying this sheet, then coating the dried sheet with an alcoholic solution of ethyl cellulose and finally drying the coating. Thus, this requires two drying steps and, moreover, a long conveyor belt, which is uneconomical and requires excessive space.

In the already mentioned paper method, for guaranteeing the tear strength of the sheet, a relatively high share of cellulose fibers is required. The slurry method requires for the same purpose a relatively high share of binding agent. All these substances, however, have a negative effect on the quality of the smoke. In the extruder method and/or roller method, in which smaller shares of water, cellulose fibers and binding agents are employed, the quality of the smoke is correspondingly better, however, the filling power, which is nowadays generally required for economical reasons, is lower.

For the improvement of the various physical properties of the sheet material produced by the extruder method and/or roller method, the sheet surface has been coated with various, both water-soluble and water-insoluble binding agents, for which purpose for instance solutions or suspensions of sodium carboxymethyl cellulose, solutions of guar gum, pectin, alginate or locust bean gum were used, which optionally also contained cross-linking agents such as glyoxal or other dialdehydes. Although it was possible in this manner to achieve a certain improvement of the physical properties, such as tear strength, of such sheets, the results of processing such sheets to cigarettes were not satisfactory.

In accordance with what has been stated above, the smokable sheets produces from disintegrated vegetable materials and/or tobacco waste are, with respect to their various properties, not completely satisfactory and it is therefore the object of the invention to produce a coherent, smokable sheet with good smoke quality, which overcomes the known disadvantages of prior art and which is in particular characterized by an increased filling power and high moisture resistance. Moreover, an economical and simple method for the manufacture of such a sheet shall be provided.

In accordance with the invention, this object is attained by a smokable sheet of the kind defined in the introduction, which is obtained by pressure-forming the vegetable materials and/or tobacco waste together with binding agents and water, the share of which is smaller than that of the dry substance employed, between forming elements, coating the formed, coherent and still moist sheet at a moisture content of 30 to 50% with a solution or suspension containing at least one water-soluble, modified pectin from the group of low-esterified pectin with an esterification degree of less than 40%, and amidified, low-esterified pectin with an amidation degree of more than 15%, the modified pectin is contacted with bivalent and/or trivalent metal ions and the coated sheet is dried, with the concentration of the modified pectin on the sheet surface being, calculated by the dry weight of the finished product, at least 0.5 percent by weight.

There is thus obtained by the extruder method and/or roller method a tobacco sheet material of high filling power and high moisture resistance. The energy requirements for the manufacture of this sheet material are considerably lower than those of the slurry method and paper method respectively, while the sheets that can be obtained according to this method moreover have a substantially improved smoke quality.

It has been unexpectedly found that the application of a viscous coating solution or coating suspension onto the surface of the not yet dried, already formed sheet having a moisture content of 30 to 50% results, after subsequent drying, in a significant improvement of the filling power of the cut smokable sheet only if the coating solution or coating suspension contains one or more low-esterified pectins with an esterification degree of less than 40%, and if a water-insoluble film is formed on one surface of the smokable sheet by contacting and reacting these modified pectins with bivalent and/or trivalent metal ions, and drying the product. This increased filling power is preserved particularly after processing the smokable product to cigarettes.

The degree of esterification of the low-esterified pectins of the invention can generally be from 0.5 to 40%, with such pectins of an esterification degree of 10 to 40% being preferred in view of the improved water-solubility of the pectins with higher esterification.

Instead of only low-esterfied pectins, according to the invention also amidified, low-esterified pectins can be used, i.e. pectins in which part of the ester groups (methyl ester groups) have been replaced by amide groups or in which part of the still free carboxyl groups have been converted to amide groups. Besides the respective esterification degree, which can be in the range of the values indicated above, such amidified, low-esterified pectins have an amidation degree of at least 15%, with pectins having an esterification degree of 35 to 20% and accordingly an amidation degree of 15 to 30% being preferred. Of course, also combinations of one or more low-esterified pectins with one or more amidified, low-esterified pectins can be employed.

Surprisingly the employ of this relatively simple and inexpensive provision imparts a sheet material of the invention manufactured by means of a pressure system with a filling power which is equal or even superior to that of the sheet material manufactured according to the paper method or slurry method, with the thus improved properties of the sheet material being preserved, particularly also after its mechanical processing into cigarettes.

According to the invention particularly also such low-esterified pectins are suitable for the sheet coating that have an esterification degree of below 10%, as such pectins are capable of forming water-insoluble films of good stability already with relatively small amounts of bivalent and/or trivalent metal ions. Due to the low water-solubility of the pectins esterified at less than 10%, it is advantageous to use their alkali metal salts, such as sodium pectinate, or their ammonium salts as well, for preparing the coating solution or coating suspension. The esterification degree of such pectinates is preferably between 0.5and 10%, and in particular between 1 and 5%.

According to the invention, the bivalent and/or trivalent metal ions preferably consist of calcium and/or magnesium and/or aluminum ions. The filling power of the products being coated in accordance with the invention with the water-insoluble film and subsequently cut is on the average between about 20 and about 60% higher than that of products manufactured in the same manner without being coated, even if the latter show a higher share of a binding agent.

The preferred concentration of the modified pectin in the coating solution or coating suspension lies between 2 to 8 percent by weight, so that the viscosity of the coating solution or coating suspension is 5000 mPa s to 60 000 mPa s at the coating temperature.

The sheet material produced in such a way already shows an improved filling power if the concentration of the modified pectin on its surface is, as referred to the dry weight of the finished product, at least 0.5 percent by weight, however, preferably between 1.2 and 1.5 percent by weight as referred to the dry weight of the finished product.

The calcium ions, magnesium ions and/or aluminum ions required for forming a non-water-soluble film may be added either to the coating solution or coating suspension or to the disintegrated vegetable materials and/or tobacco waste. In order to avoid premature gelation, the ions are preferably added to the coating solution or coating suspension in the form of water-insoluble salts such as $CaCO_3$, $Ca_3(PO_4)_2$, $AlPO_4$, $MgCO_3$ and the like. If the ions are to be added to the disintegrated vegetable material and/or tobacco waste, it is also possible to employ soluble salts such as lactates, sulfates and the like. In both cases the water-insoluble film is formed by the exchange of the bivalent and/or trivalent metal ions with cations of the soluble modified pectins during drying of the coated product. The concentration of the above ions lies, depending on the form of employ and the type of the coating material, preferably between 0.5 and 20 percent by weight as referred to the dry weight of the modified pectin, if they are added to the coating solution or coating suspension, and between 0.5 and 10 percent by weight as referred to the dry weight of the finished product, if they are added to the disintegrated vegetable materials and/or tobacco waste. These limits are only approximate values, so that the required amounts of ions may be smaller or greater, depending on the type of modified pectin.

The invention shall now be explained in detail with reference to the following examples:

EXAMPLE 1

Ground tobacco waste, binding agents (NaCMC=sodium carboxymethyl cellulose), calcium carbonate and water were thoroughly mixed and rolled to a sheet material on a three-roller mill. On the third roll, the sheet material was coated with different coating solutions by means of a roll kiss coater, whereafter it was guided into a perforated belt, pre-dried, and adjusted to a final moisture content of 14 to 16 percent by weight in a drum dryer. Table 1 shows the composition of the different sheet materials.

TABLE 1

| | A | B | C | D | E | F |
|---|---|---|---|---|---|---|
| Ground tobacco (g) | 91,0 | 92,5 | 92,5 | 92,5 | 92,5 | 92,5 |
| Binding agent (NaCMC) directly mixed with ground tobacco (g) | 6 | 3 | 3 | 3 | 3 | 3 |
| Calcium carbonate (g) | 3 | 3 | 3 | 3 | 3 | 3 |
| Coating with: (each in g) | | | | | | |
| low-esterified pectin with an esterification degree of about 30 to 38% | — | 1,5 | — | — | — | — |
| high-esterified pectin with an esterification degree of about 60 to 70% | — | — | 1,5 | — | — | — |
| Na—carboxymethyl cellulose | — | — | — | 1,5 | — | — |
| guar gum | — | — | — | — | 1,5 | — |
| amidified, low-esterified pectin with an amidation degree of about 22% and an esterification degree of about 28% | — | — | — | — | — | 1,5 |

The different sheet samples A to F were cut to strips of 1 mm width parallel to the rolling direction as well as transversely to the rolling direction, their moisture was adjusted to a water content of 14% and subsequently their filling power was measured by means of a Borgwaldt densimeter.

Table 2 shows that the sheet coated with low-esterified pectin (B) and amidified, low-esterified pectin (F) retained improved filling power even after processing to cigarettes in spite of the reduced overall share of binding agents as compared to the non coated sheet (A). In case of sheets (C), (D) and (E) the originally achieved increased filling power was lost during processing to cigarettes.

TABLE 2

| | A | B | C | D | E | F |
|---|---|---|---|---|---|---|
| Filling power at 14% water content (measured densimetrically) ($cm^3/g$), cut: | | | | | | |
| in rolling direction | 4.20 (−) | 5.03 (+19.8%) | 4.35 (+3.6%) | 4.91 (+16.9%) | 4.75 (+13.1%) | 5.30 (+26.2%) |
| transversely to rolling direction | 3.21 (−) | 4.58 (+42.7%) | 3.57 (+11.2%) | 4.20 (+30.8%) | 4.02 (+25.2%) | 4.68 (+45.8%) |
| mechanically manufactured cigarettes with 20% cut sheet and 80% conventional tobacco mixture: | | | | | | |
| mean weight of cigarettes at equal hardness and equal moisture (mg) | 985 (−) | 916 (−7.0%) | 989 (+0.4%) | 973 (−1.2%) | 979 (−0.6%) | 910 (−7.6%) |

EXAMPLE 2

Tobacco sheets were manufactured in the same way as in example 1 and coated on one surface with different amounts of low-esterified pectin with an esterification degree of about 20 to 22%. The coating solution thereby contained calcium ions in an amount of 2% by weight as referred to the low-esterified pectin.

TABLE 3

| Sheet coated with low-esterified pectin | | | | | | | | |
|---|---|---|---|---|---|---|---|---|
| pectin quantity (percent by weight, as referred to the dry weight of the sheet) | 0.2 | 0.5 | 0.8 | 1.0 | 1.2 | 1.5 | 2.0 | 2.5 |
| filling power at 14% water content (measured densimetrically) ($cm^3/g$): | | | | | | | | |
| cut in rolling direction ($cm^3/g$) | 4.02 | 4.26 | 4.53 | 4.9 | 4.9 | 5.08 | 5.2 | 5.2 |
| cut transversely to rolling direction ($cm^3/g$) | 2.91 | 3.18 | 3.61 | 4.02 | 4.2 | 4.6 | 4.64 | 4.68 |

It can be seen from table 3 that the filling power increases with the increasing concentration of the coating material on the sheet surface. Above 1.5%, however, the increase of the filling power improvement is noticeably reduced.

The same applies to sheets made of so-called tobacco substitutes such as ground vegetable materials as for instance shells of cocoa beans, shells of coffee beans or wood cellulose.

EXAMPLE 3

Sheet A was prepared by thoroughly mixing 2300 g ground tobacco waste with 50 g sodium carboxymethyl cellulose, 37.5 g guar gum, 25 g magnesium formate and 50 g aluminum sulfate in the dry state, and subsequently with 1000 g water. The moist but still flowable mass was formed into a sheet on a three-roller mill. On the third roller the still moist sheet was coated with a 5% solution of sodium pectinate (esterification degree of the pectin about 1 to 4%, viscosity of the solution about 40 000 mPa s at room temperature) by means of a roll kiss coater, in such an amount that the finished sheet contained 1.5 percent by weight of sodium pectinate on its surface. The coated sheet was then dried on a belt to a moisture of 14% water content.

Sheet B was prepared of the same material and additives as sheet A, with the difference that it was not coated but contained instead 1.5 percent by weight of the same sodium pectinate in the basic mass.

Sheet C was prepared of the same material and additives as sheets A and B, with the difference that the preparation was carried out according to the paper method.

All three types of sheets were cut diagonally to the rolling direction into 1 mm wide strips of equal length by means of a document shredder, the moisture was uniformly adjusted to 14% water content and the filling power was subsequently measured by means of a Borgwaldt densimeter. Additionally, cigarettes were made of the three types of sheet material, which were then judged by a smoker's panel. The results were summarized in table 4

TABLE 4

| | sheet A | sheet B | sheet C |
|---|---|---|---|
| Filling power ($cm^3/g$) | 5.4 | 3.8 | 5.3 |
| Smoker's judgement | aromatic, pronounced tobacco character no aftertaste | aromatic, pronounced tobacco character, practically no difference to A | empty, no tobacco flavour cellulosic harshness |

I claim:

1. A smokable, coherent sheet of disintegrated vegetable material and/or tobacco waste, comprising a dried pressure-formed sheet of said disintegrated vegetable material and/or tobacco waste, having a water-insoluble surface coating formed by the exchange of bivalent and/or trivalent metal ions of a salt with cations of at least one water-soluble, modified pectin from the group of low-esterified pectins with an esterification degree of below 40% and/or amidified, low-esterified pectin with an amidation degree of over 15%, with the concentration of the modified pectin on the sheet surface based on weight of the finished product being at least 0.5% by weight.

2. A smokable sheet in accordance with claim 1, characterized in that the modified pectin consists of one or more low-esterified pectins with an esterification degree of below 10% and is in the form of alkali metal pectinate and/or ammonium pectinate.

3. A smokable sheet in accordance with claim 1, characterized in that the bivalent and/or trivalent metal ions consist of calcium ions and/or magnesium ions and/or aluminum ions.

4. A smokable sheet in accordance to claim 1 characterized in that the concentration of the modified pectin in the coating solution or the coating suspension is 2 to 8 percent by weight.

5. A smokable sheet in accordance to claim 1, characterized in that the viscosity of the coating solution or coating suspension is 5000 mPa s to 60 000 mPa s at the coating temperature.

6. A smokable sheet of in accordance to claim 1 characterized in that the concentration of the modified pectin is, as referred to the dry weight of the finished product, 1.2 to 1.5 percent by weight on the product surface.

7. A smokable sheet of in accordance to claim 1, characterized in that the coating solution or coating suspension is mixed with 0.5 to 20 percent by weight of calcium ions and/or magnesium ions and/or aluminum ions, as referred to the amount of the modified pectin.

8. A smokable sheet in accordance to claim 1, characterized in that the calcium ions and/or magnesium ions and/or aluminum ions are added to the disintegrated, vegetable materials and/or tobacco waste in a concentration of 0.5 to 10 percent by weight, as referred to the dry weight of the finished product.

9. A smokable sheet in accordance to claim 1, characterized in that the calcium ions and/or magnesium ions and/or aluminum ions are added to the coating solution or coating suspension containing the modified pectin, in the form of water-insoluble calcium salts, and/or magnesium salts and/or aluminum salts.

10. A smokable sheet in accordance to claim 1, characterized in that the calcium ions and/or magnesium ions and/or aluminum ions are added to the disintegrated vegetable materials and/or tobacco waste in the form of water-soluble calcium salts and/or magnesium salts and/or aluminum salts.

* * * * *